US005381606A

United States Patent [19]

Solimar

[11] Patent Number: 5,381,606

[45] Date of Patent: Jan. 17, 1995

[54] AERATION DEVICES AND METHODS

[76] Inventor: Keith F. Solimar, 1289 Brighton Sq., New Brighton, Minn. 55112

[21] Appl. No.: 33,853

[22] Filed: Mar. 19, 1993

[51] Int. Cl.[6] ..... F26B 17/00

[52] U.S. Cl. ..... 34/585; 34/582; 411/411; 411/426; 411/265

[58] Field of Search ..... 34/218, 359, 360, 364, 34/369, 576, 582, 583, 584, 585; 110/245; 432/58; 165/104.16; 239/600; 411/411, 412, 415, 426, 424, 437, 178, 265

[56] References Cited

U.S. PATENT DOCUMENTS

| | | | |
|---|---|---|---|
| 2,407,552 | 9/1946 | Hoesel | 411/426 |
| 2,890,838 | 6/1959 | Jannsen | 239/534 |
| 3,393,943 | 7/1968 | Kelly | 302/53 |
| 3,754,740 | 8/1973 | Piper | 261/124 |
| 3,929,261 | 12/1975 | Solimar | 222/195 |
| 3,952,956 | 4/1976 | Steele | 239/289 |
| 4,172,539 | 10/1979 | Botkin | 222/195 |
| 4,662,543 | 5/1987 | Solimar | 222/195 |

OTHER PUBLICATIONS

Cyclonaire document entitled "Vibra-Pad Vibrating Air Pad", 2 pages (Exhibit A).

Solimar document entitled "Silo Fluidizer—Quality Components for Pneumatic Systems", 3 pages, dated Apr., 1992, and 1 page price list, dated Oct., 1991. (Exhibit B).

Cyclonaire document entitled "Vibra-Pad Bin Aerator", 4 pages. (Exhibit C).

Table entitled "Dimensions of external and internal straight pipe threads for locknut connections", 1 page. (Exhibit D).

Oberg, Erik and F. D. Jones, *Machinery's Handbook for Machine Shop and Drafting-Room,* Horton, Holbrook L., ed., 3 cover pages, and pp. 1016–1017, and 1020–1021, dated 1955, New York, N.Y. (Exhibit E).

Parker Fluid Connectors document entitled "Metric Fittings, Tubing, Tools", cover page, pp. 10–14, and back page, dated Jun., 1983. (Exhibit F).

*Primary Examiner*—Denise L. Gromada

*Attorney, Agent, or Firm*—Merchant, Gould, Smith, Edell, Welter & Schmidt

[57] ABSTRACT

A bin aeration device includes a skirt mounted to a bin wall by a stem including an exterior surface with a first portion having straight American National Standard pipe threads. A second portion on the exterior surface includes American National Standard Taper Pipe Threads. The American taper pipe threads permit attachment of either an internally American taper threaded fitting or an internally British taper threaded fitting if provided with ½ inch or ¾ inch—14 threads per inch threads. An interior surface through the stem defines a passageway for pressurized gas to exit through an air port adjacent the skirt. A portion of the interior surface of the stem includes British Standard Taper Pipe threads. The British taper pipe threads permit attachment of either an externally American taper threaded fitting or an externally British taper threaded fitting if provided with ½ inch or ¾ inch—14 threads per inch threads. An alignment land is provided on the stem with an appropriate size to permit positioning of the land in a hole drilled by certain standard American drill bits or certain standard metric drill bits.

24 Claims, 5 Drawing Sheets

AERATION DEVICES AND METHODS

FIELD OF THE INVENTION

The present invention relates to devices for the introduction of air or other pressurized gas into dry bulk material to fluidize the material for efficient pneumatic transfer.

BACKGROUND OF THE INVENTION

In the prior art, aeration systems are well known for use in pneumatic trailer tanks, rail cars, storage tanks, and other containers. Such systems include aeration devices connected to pressurized air sources. The aeration devices which introduce air into the containers to aerate dry bulk materials, such as flour, sugar, starch, fertilizer, plastic resins, cement, fly-ash, and other particulate materials stored within the containers. Such prior art devices may include a flexible element which provides a seal when air pressure is terminated but permits passage of air from the device into the container when air pressure is initiated. An example of such device may be found in my U.S. Pat. No. 4,662,543, dated May 5, 1987.

U.S. Pat. No. 4,662,543 teaches an aeration device comprising a resilient flexible skirt which has an inner generally conical surface and an outer generally conical surface. An anchor stud and cup arrangement is provided for securing the skirt to an inside surface of a container wall with a base end of the skirt opposing the inside surface and with the anchor stud and cup arrangement drawing the skirt axially toward the wall to prestress the skirt. The skirt cooperates with the inside surface of the wall to define a pressure chamber. Means are provided for supplying a flow of pressurized air from a source external of the container to the pressure chamber. From the pressure chamber, the air passes under the base end of the flexible skirt and into the container to fluidize the bulk material.

Other aeration devices are known which include a flexible skirt mounted to a threaded stem with an internal air passageway in the stem as shown in FIG. 1A. In FIG. 1A, a flexible skirt 10*a* is mounted to a first end 12*a* of a stem 14*a*. Straight threads 16*a* are provided at an opposite end 18*a* of stem 14*a* on an exterior surface of the stem. The straight threads permit a threaded member, such as a nut 20*a*, to mount the stem to the container wall 22*a*. A flexible seal member 24*a* seals between the container wall 22*a* and stem 14*a*. An inner passageway 26*a* is defined in stem 14*a* for the passage of pressurized air from end 18*a* toward end 12*a* through air ports 28*a*. Internal taper pipe threads 30*a* are provided on stem 14*a* to permit interconnection of stem 14*a* to an appropriately sized threaded coupling extending from a source of pressurized air.

Several problems arise when mounting the aeration device of FIG. 1A to the container. A first problem relates to the connection of the aeration device to the container wall. If too large a hole is drilled in the container wall, the aeration device may become misaligned and the seal member may not seal properly. If the seal member does not provide a proper seal, the pressurized air may exit the container between the stem and the wall, instead of fluidizing the container contents.

Another problem related to mounting the aeration device of FIG. 1A to the container concerns the threaded interconnection of the aeration device to the pressurized air supply. Problems arise for aeration device manufacturers, aeration device suppliers, and/or aeration device installers when the aeration devices threadably interconnect to pressurized air supplies. Special emphasis must be placed on providing the appropriate threads on the aeration device to permit interconnection to the pressurized air supply provided. An example of two different thread types that may be encountered on the couplings extending from the pressurized air supplies are (1) American National Standard Taper Pipe Threads; and (2) British Standard Taper Pipe Threads. An appropriately threaded stem of the type in FIG. 1A needs to be provided to threadably mount to a fitting extending from the pressurized air supply. This can raise manufacturing costs if different parts are required to interconnect to differently threaded fittings. This can also result in a large inventory of different parts needing to be maintained by the supplier. It can also result in the installer having to use extra care when obtaining the appropriate parts for installing the aeration system.

A related installation problem concerns how the installer handles different air supplies of varying pressures and/or varying fittings. For example, the pressurized air supply may include a flexible tube or hose having a particular size. The installer has to mount the tube or hose to the aeration device. The installer is therefore concerned with how easily the connection can be made between the aeration device and the pressurized air supply.

There is a need in the art for aeration devices and methods which address the above concerns and other concerns.

SUMMARY OF THE INVENTION

One aspect of the present invention relates to an aeration device including a stem for mounting to a container wall wherein the stem is provided with a shaft having an exterior surface, and an interior surface defining a passageway for pressurized gas. The exterior surface of the stem is provided with American National Standard straight pipe threads (hereinafter referred to as "American straight pipe threads" or "American straight threads") for a portion of the external surface. Another portion of the exterior surface is provided with American National Standard Taper Pipe Threads (hereinafter referred to as "American taper pipe threads" or "American taper threads"). The interior surface is provided with British Standard Taper Pipe Threads (hereinafter referred to as "British taper pipe threads" or "British taper threads").

The straight threads on the exterior surface are provided for a lock nut or other threaded member to mount the stem to the container wall. The internal taper threads and the external taper threads are provided to threadably connect the stem to a source of pressurized gas, such as air. Appropriately sized American taper threads on the exterior surface of the stem can receive either a fitting with internal British taper threads or a fitting with internal American taper pipe threads. Appropriately sized British taper threads on the interior surface of the stem can receive either a fitting with external British taper threads or a fitting with external American taper pipe threads. The stem further includes means for holding a flexible skirt. In use, the flexible skirt controls the passage of gas from the stem into the container.

With appropriately sized stems, there is less emphasis on matching thread types between the aeration device and the fitting of the pressurized air supply since some British taper threads are useable with some American taper threads. A manufacturer, supplier, or installer of aeration devices who wishes to provide matching capability with either the American or British taper threads of the fittings of the pressurized air supplies need only supply one or more sizes of American threaded aeration devices or one or more sizes of British threaded aeration devices.

Preferred embodiments of the invention include providing at least one of: (1) American taper pipe threads on the exterior surface of the stem; and (2) British taper pipe threads on the interior surface of the stem, wherein at least one of the taper pipe threads is provided with either ½ inch—14 threads per inch pipe threads or ¾ inch—14 threads per inch pipe threads in the appropriate thread standard—British or American.

Another aspect of the invention relates to an aeration device which is mountable through a hole in a wall of a container. The aeration device includes a flexible skirt and a stem mounted to the skirt. The stem includes a shaft with an exterior surface, and an interior surface defining a passageway for pressurized gas. The exterior surface includes a portion with straight threads. Another portion of the exterior surface of the shaft includes taper threads for threadably engaging an internally threaded fitting with taper threads wherein the fitting permits interconnection too a pressurized gas supply.

In one preferred embodiment of the aeration device with external taper threads, the interior surface also includes taper threads. When both internal and external taper threads are provided, a more versatile aeration device is provided since the installer has more options for connecting to the pressurized gas supply, using either an internally threaded fitting or an externally threaded fitting.

Another aspect of the invention relates to an aeration system including a container having a wall with a hole through the wall. An aeration device mounted to the container wall includes a flexible skirt and a stem mounted to the skirt. The stem includes a shaft which extends through the hole in the container wall. The flexible skirt is positioned in an interior of the container. The shaft includes a land which is positionable adjacent the surface of the container wall defining the hole. The land facilitates alignment of the aeration device in the hole. The shaft further includes threads on an exterior surface of the shaft for receipt of a nut or other threaded member to mount the stem to the container wall. An interior surface of the shaft defines a passageway for pressurized gas. The land preferably defies a diameter greater than or equal to the diameter defined by the threads on the exterior surface. The exterior surface may include taper threads for receiving a fitting. The interior surface may include taper threads for receiving a fitting.

One preferred embodiment of stem including the land includes providing the hole with a circular diameter less than or equal to ⅞ inches and greater than or equal to 22 millimeters, with the threads on the exterior surface including ½ inch—14 threads per inch American straight threads, and the land being greater or equal to 0.858 inches and less than 22 millimeters. To install this seem, it is preferred that the hole is drilled either with a ⅞ inch American drill bit or a 22 millimeter metric drill bit.

Another preferred embodiment of a stem including the land includes providing the hole with a circular diameter less than or equal to 27 millimeters and greater than or equal to 1 and 1/16 inches, with the threads on the exterior surface including ¾ inch—14 threads per inch American straight threads and the land being greater or equal to 1.054 inches and less than 1 and 1/16 inches. For installation of this stem, it is preferred that the hole is drilled either with a 1 and 1/16 inch American drill bit or a 27 millimeter metric drill bit.

A further preferred embodiment of a stem including the land includes providing the hole with a circular diameter less than or equal to 35 millimeters and greater than or equal to 1 and ⅜ inches, with the threads on the exterior surface including 1 inch American straight threads and the land being greater or equal to 1.368 inches and less than 1 and ⅜ inches. To install this preferred embodiment, it is preferred that the hole is drilled either with a 1 and ⅜ inch American drill bit or a 35 millimeters metric drill bit.

Selecting a proper hole size through the container wall to achieve a proper seal is not a problem for the installer since the land sizes have been selected to match up well with certain standard drill bits. Stems having appropriately sized lands with the above features provide a satisfactory seal with an appropriately positioned seal means whether the installer has an American drill bit set or a metric drill bit set with the sizes of drill bits typically provided or available in those sets.

BRIEF DESCRIPTION OF THE DRAWINGS

In the drawings, where like numerals refer to like components throughout the several views.

DETAILED DESCRIPTION OF THE PREFERRED EMBODIMENTS

Figure 1:
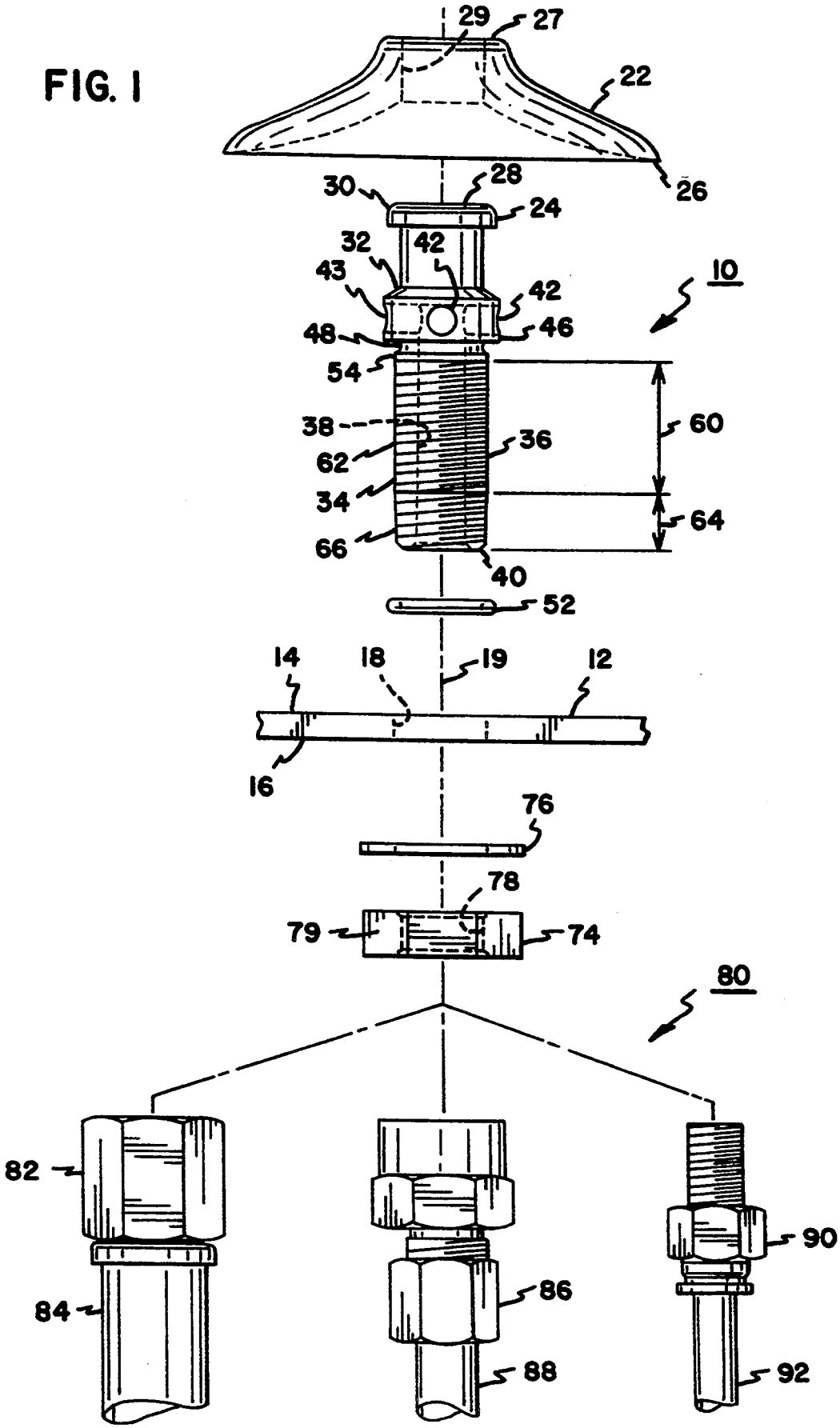
FIG. 1 is an exploded view of an aeration system according the present invention, showing three alternative couplings attachable to the stem of the aeration device.
Figure 1A:
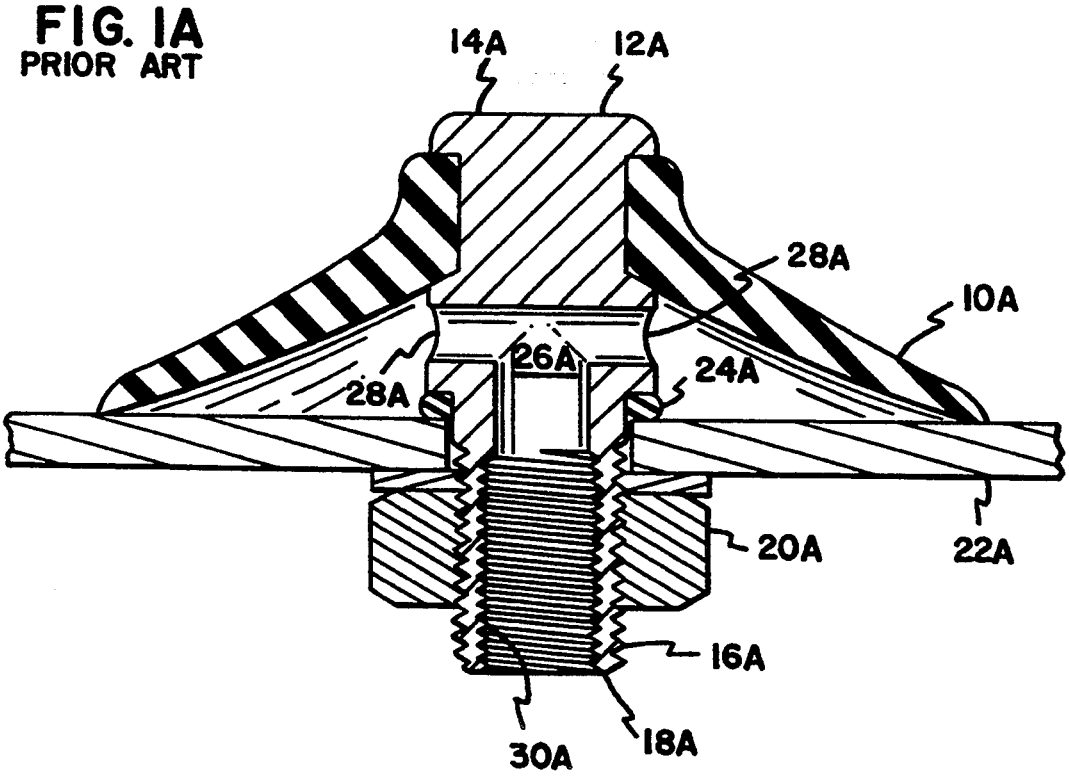
FIG. 1A PRIOR ART
FIG. 1A is a cross-sectional view of a prior art aeration device.
Figure 2:
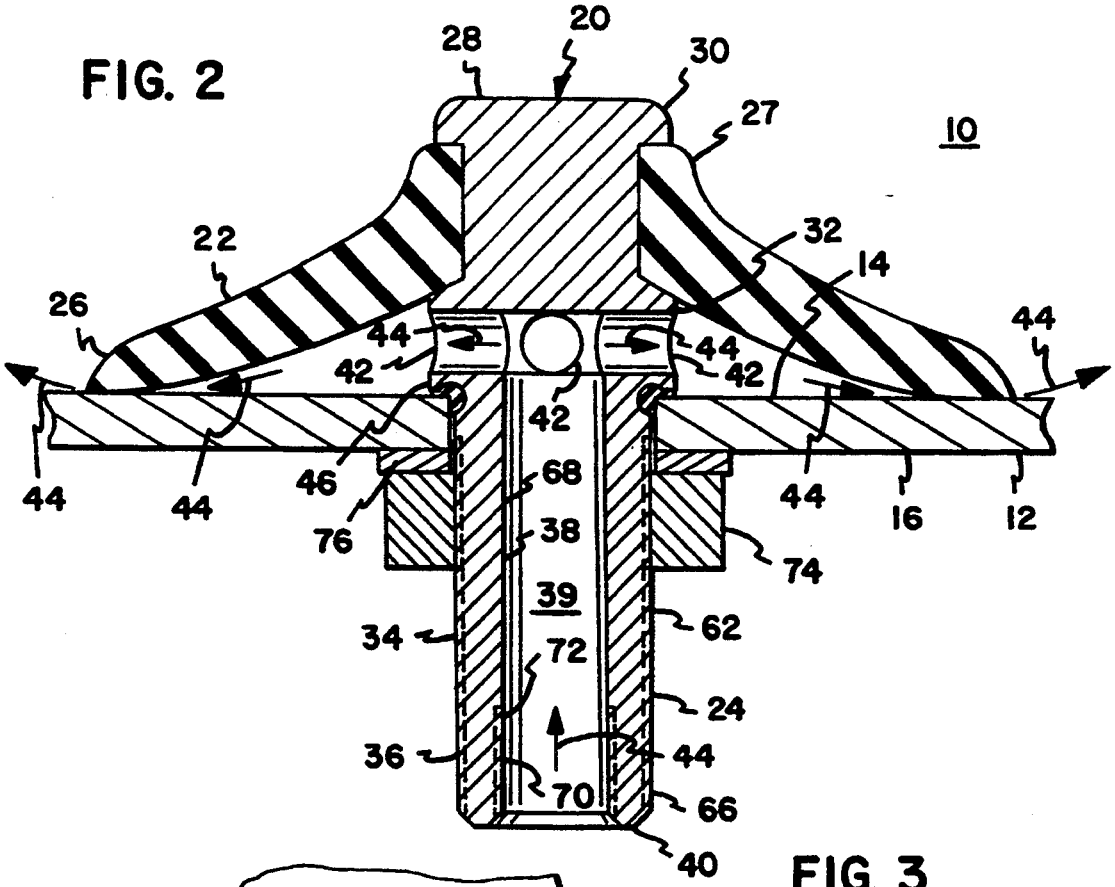
FIG. 2 is an enlarged cross-sectional assembly view of the aeration system shown in FIG. 1.

Referring now to FIGS. 1 and 2, an aeration system 10 is shown in accordance with principles of the present invention. Aeration system 10 includes a container or tank wall 12 which defines a container for holding bulk material. Tank wall 12 includes an inside surface 14 and an outside surface 16. Wall surface portion 18 defines a hole through tank wall 12. Tank wall 12 may be any of a variety of sizes such 3/16 inches thick or less to ⅜ inches thick or more. Tank wall 12 may be made from a variety of materials such as steel or aluminum.

As shown in FIG. 2, system 10 includes an aeration device 20 mounted to tank wall 12. Aeration device 20 is received by hole 18 in a direction of axis 19 noted in FIG. 1. Aeration device 20 includes a skirt 22 and a stem 24. Skirt 22 is formed of a flexible resilient material (preferably silicon rubber to withstand elevated temperatures). An edge 26 of skirt 22 is engageable with inside surface 14 of tank wall 12 to seal the interior of the container from the pressurized gas source (not shown). Edge 26 is movable away from inside surface 14 to permit pressurized gas to flow to an interior of the container from an exterior of the container through aeration device 20. Center region 27 of skirt 22 includes a hole for receipt of an end 28 of stem 24. End 28 of stem 24 includes a first shoulder 30 and a second shoulder 32 which trap and hold a portion of center region 27 of skirt 22 to mount skirt 22 to stem 24. Skirt 22 functions as a valve for controlling air flow into the container through aeration device 20. Skirt 22 also keeps the contents of the container from exiting the container through aeration device 20.

Extending from second shoulder 32 is a shaft 34 which includes an exterior surface 36 and an interior surface 38. Interior surface 38 defines a passageway 39 extending from second end 40 of stem 24 to air ports 42. The passageway provides a gas flow path through aeration device 20 such that pressurized gas can enter aeration device 20 at second end 40, pass through air ports 42 and into the interior of the container by passing between the lifted away edge 26 of skirt 22. The direction of air flow during operation through aeration device 20 is represented by arrows 44 shown in FIG. 2.

Figure 3:
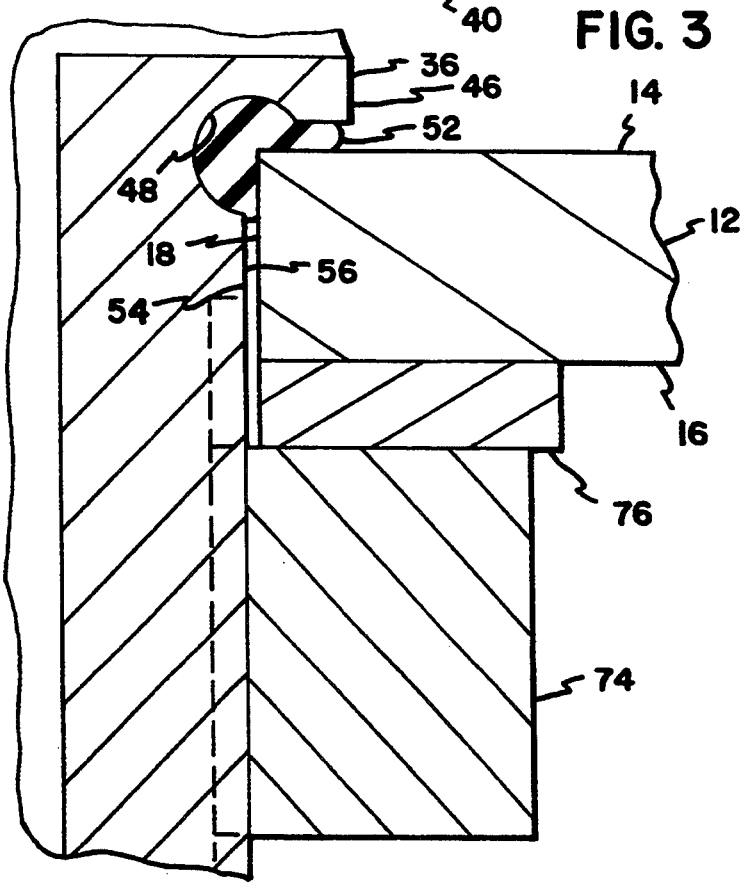
FIG. 3 is an enlarged cross-sectional view of a portion of the aeration system shown in FIG. 2.

As shown in FIGS. 1–3, exterior surface 36 of shaft 34 includes a third shoulder 46. Adjacent third shoulder 46 is a recessed surface 48 defining a chamber for receipt of o-ring 52. O ring 52 is positioned in the chamber defined by recess surface 48 prior to mounting aeration device 20 to the container. Recess 48 helps maintain o ring 52 in the appropriate location once positioned on stem 24. Adjacent recessed surface 48 is a land 54 having a surface 56 extending generally parallel to axis 19.

Exterior surface 36 of shaft 34 includes a first region 60 having straight pipe threads 62. One preferred thread design is ¾ inch—14 threads per inch American straight pipe threads (loose fit). Those skilled in the art may refer to these threads as ¾ inch—14 NPSL threads. Such threads are useful for receiving a lock nut. Second region 64 of exterior surface 36 includes taper pipe threads 66 to sealingly engage an appropriate fitting. Interior surface 38 includes a bore surface 68 and a taper thread region 70 with taper pipe threads 72 to sealingly engage an appropriate fitting if threads 66 are not utilized.

A lock nut 74 and a washer 76 are provided to threadably mount stem 24 and skirt 22 to tank wall 12. Lock nut 74 includes internal threads 76 which are threadably received by taper pipe threads 66 initially, and then straight pipe threads 62 as lock nut 74 is rotated along the threads of shaft 34. Internal threads 78 are provided with an appropriate size to match straight pipe threads 62. When aeration device 20 is mounted to tank wall 12, lock nut 74 is positioned on and threadably engaged with straight pipe thread 62 in the preferred embodiment. Lock nut 74 is shown to include a hex head outer surface 79 for convenient turning with a wrench or other tool. O ring 52 is shown in FIGS. 2 and 3 in its compressed state between recess surface 48, third shoulder 46, and inside surface 14 and surface portion 18 defining the hole through wall 12. Land 54 is positioned adjacent surface portion 18 of wall 12 to align stem 22 in the hole through wall 12.

As shown in FIG. 1, fitting means 80 mounts to aeration device 20 to provide aeration device 20 with a source of pressurized gas. Three alternative fitting means 80 are shown in FIG. 1. Others are anticipated. As shown in FIG. 1, the fitting means 80 may include a coupling 82 which engages an inside surface of conduit 84. Coupling 82 has internal taper threads for engaging external taper threads 66 on stem 24. A second coupling 86 engages an exterior surface of conduit 88. Second coupling 86 includes internal taper threads for engaging external taper threads 66 on stem 24. Connector 90 engages an exterior of conduit 92. Connector 90 is provided with external taper threads for engaging internal taper threads 72 on stem 24. Internal taper threads 72 and external taper threads 66 are self sealing when engaged by appropriately threaded fitting means 80 with either internally or externally taper threads. Conduit 84, 88, 92 may be a suitably sized tube or hose. As shown in FIG. 1, conduit 84, 88, 92 can have a variety of different inside diameters. These different diameters may be used to achieve desired air flow depending on the pressure of the air supply.

In operation, aeration device 20 typically requires certain volumes of air flow per unit time in order to effectively fluidize the particular contents of the container. If a compressor source of air is provided, such as a plant air source, over 100 pounds per square inch (p.s.i.) may be available for use. With respect to a blower or other air conveying system, typically 15 to 20 p.s.i. may be available. These blowers may be portable units. To deliver equivalent volumes of air per unit time, larger tubes or hoses are usable with pressure sources with less p.s.i. Providing both internal taper pipe threads 72 and external taper pipe threads 66 provides a more versatile stem 24 since various fitting means 80 including one of couplings 82, 86, or connector 90 and the like may be utilized depending upon the size of the tube or hose available, and the nature of the air supply.

Stem 24 is provided with American National Standard taper pipe threads for external taper pipe threads 66 in the preferred embodiment. More preferably, threads 66 of stem 24 include ¾ inch—14 threads per inch American National Standard taper pipe threads. The ¾ inch type thread may also be designated ¾ inch—14 NPT threads by those skilled in the art. Taper pipe threads 66 of this type will receive and seal with either a coupling with ¾ inch—14 threads per inch British Standard taper pipe threads or ¾ inch—14 threads per inch American taper pipe threads. Those skilled in the art may refer to the British threads as ¾ inch—14 BSPT threads. The British taper threads are slightly larger than the American taper threads. However, there are the same number of threads per inch in British taper threads and American taper threads for the ¾ inch size in either system. This is important for permitting stem 24 and the fitting to threadably turn relative to each other until a seal is formed.

Stem 24 is used to advantage for manufacturers, suppliers, or installers since a fitting with internal British taper threads of ¾ inch can be threaded onto the stem or a fitting with internal American taper threads of ¾ inch can be threaded onto the stem.

Figure 4:
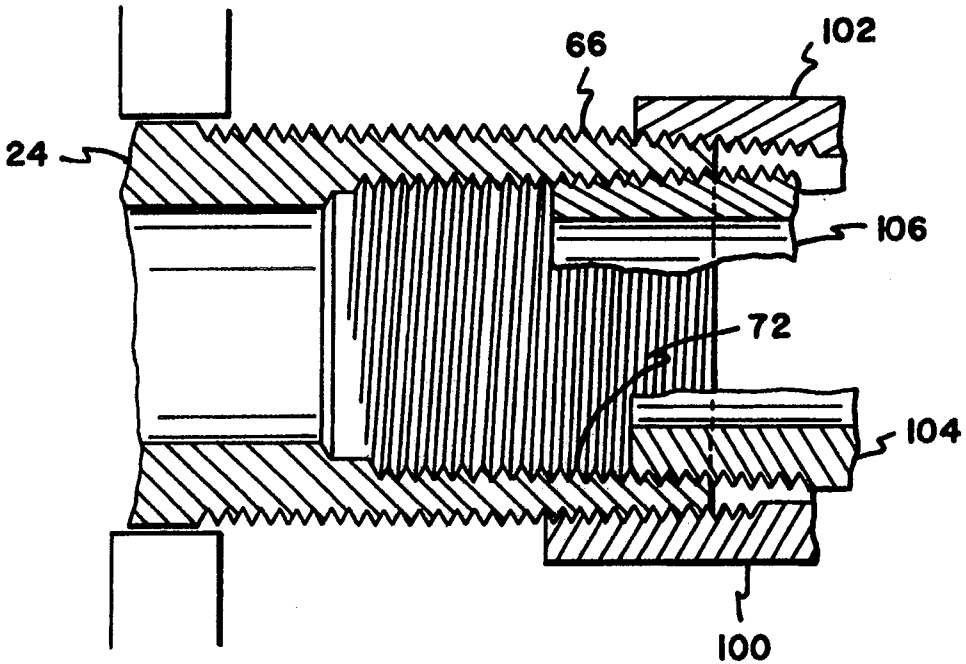
FIG. 4 is an enlarged cross-sectional view of a portion of the aeration system shown in FIG. 2, showing four alternative couplings mounted to the stem of the aeration device.

Referring now to FIG. 4, the differences between the British and American taper threads is shown with respect to engagement with external taper threads 66 of stem 24. Fitting 100 (also referred to as a "female coupling") is provided with ¾ inch—14 threads per inch British taper threads (¾ inch—14 BSPT). Fitting 102 is provided with ¾ inch—14 threads per inch American taper threads (¾ inch—14 NPT). As shown in FIG. 4, British fitting 100 is threaded onto stem 24 further than American fitting 102. However, an appropriate seal between the threads is provided by either fitting.

Stem 24 is provided with British Standard taper pipe threads for internal taper pipe threads 72 in the preferred embodiment. More preferably, threads 72 of stem 24 include ½ inch—14 threads per inch British Standard taper pipe threads. Those skilled in the art may refer to these threads as ½ inch—14 BSPT threads. Taper pipe threads 72 of the ½ inch type British taper pipe threads will receive and seal with either a fitting with ½ inch—14 threads per inch British Standard taper pipe threads or ½ inch—14 threads per inch American taper pipe threads. The British taper threads are slightly larger than the American taper threads. However, there are the same number of threads per inch in British taper threads and American taper threads for the ½ inch size in either system. This is important for permitting stem 24 and the fitting to threadably turn relative to each other until a seal is formed.

Stem 24 is used to advantage for manufacturers, suppliers, or installers since a fitting with external British taper threads of ½ inch can be threaded onto the stem or a fitting with external American taper threads of ½ inch can be threaded onto the stem.

Referring again to FIG. 4, the differences between the British and American taper threads is shown with respect to engagement with internal taper threads 72 of stem 24. Fitting 104 (also referred to as a "male connector") is provided with ½ inch—14 threads per inch British taper threads (½ —14 BSPT). Coupling 106 is provided with ½ inch—14 threads per inch American taper threads (½ —14 NPT). As shown in FIG. 4, American fitting 106 is threaded onto stem 24 further than British fitting 104. However, an appropriate seal between the threads is provided by either fitting.

By providing stem 24 with internal British taper threads and/or external American taper threads of an appropriate size, a more versatile stem 24 results. Moreover, it is only necessary for a stem manufacturer and/or supplier to supply a stem 24 with at least one of:

½ inch British internal taper threads, ¾ inch British internal taper threads, ½ inch American external taper threads, or ¾ inch American external taper threads in order to supply a stem 24 which is usable by appropriately threaded fitting whether American or British threaded. For example, an installer of aeration device 20 who has either a ½ inch internal British taper threaded fitting or a ¾ inch external British taper threaded fitting, need only order or obtain a stem 24 with the appropriate ½ or ¾ internal or external threads thereon in either British or American taper threads. With respect to stem 24, a stem manufacturer and/or supplier need only maintain one style stem 24 in inventory, that being stem 24 provided with ¾ inch American taper pipe threads on the external surface and ½ inch British taper threads on the interior surface, in order to permit interconnection of stem 24 to one of four different fittings: (1) a fitting with external British taper threads—½ inch, (2) a fitting with external American taper threads—½ inch, (3) a fitting with internal British taper threads—¾ inch, and (4) a fitting with internal American taper threads—¾ inch.

Stem 24 may be made from a variety of materials. One preferred material is aluminum. It is preferred that stem 24 be machined from a rod 1 and ⅜ inches in diameter during manufacture of stem 24. Aluminum 6061 may be used.

Advantages also result for taper pipe threads 72 on the interior surface 38 of stem 24 if they are ¾ inch—14 threads per inch British taper threads, instead of the internal ½ inch—14 threads per inch British taper threads as provided on stem 24. Appropriately sized internal threads of stem 24 can receive either external British taper pipe threads of ¾ inch or American taper pipe threads of ¾ inch.

Advantages also result for taper pipe threads 66 on the exterior surface 36 of stem 24 if they are ½ inch—14 threads per inch American taper threads, instead of the external ¾ inch—14 threads per inch American taper threads as provided on stem 24. Appropriately sized internal threads of the stem 24 can receive either external British taper pipe threads of ½ inch or American taper pipe threads of ½ inch.

Figure 6:
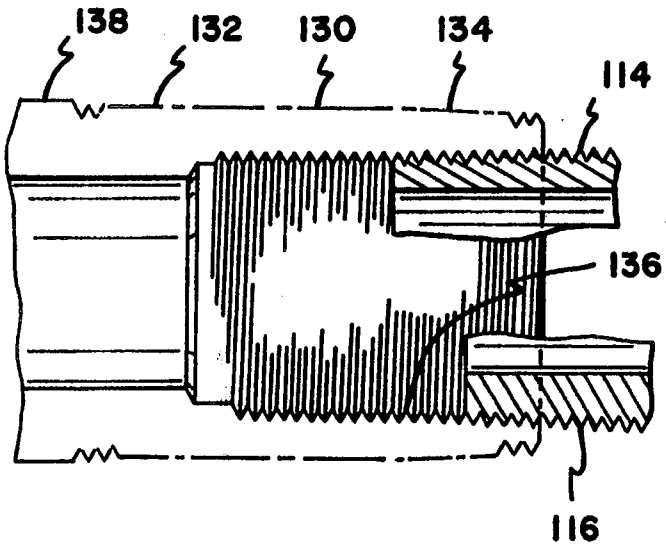
FIG. 6 is a cross-sectional view of a portion of a second alternative stem to the stem shown in FIGS. 1 through 4 and to the first alternative stem of FIG. 5, showing two alternative fittings mounted in the stem.
Figure 5:
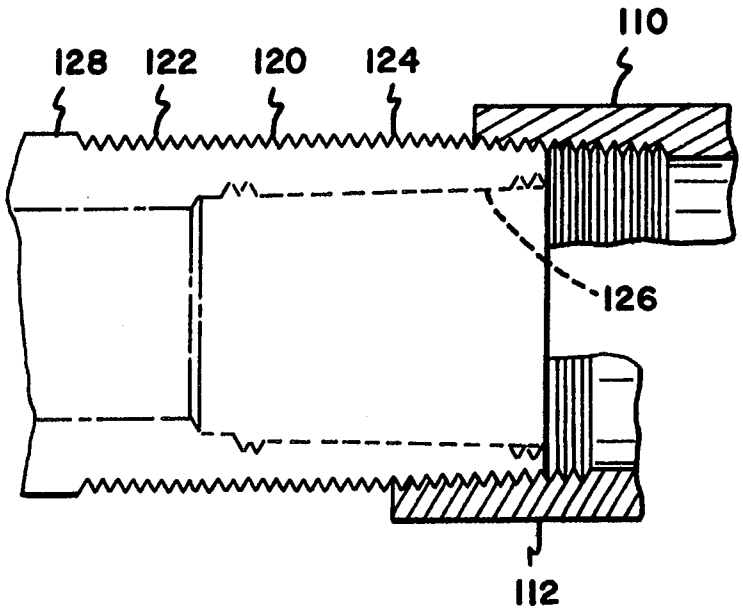
FIG. 5 is a cross-sectional view of a portion of a first alternative stem to the stem shown in FIGS. 1 through 4, showing two alternative couplings mounted to the stem.

Referring now to FIGS. 5 and 6, a first alternative stem 120 and a second alternative stem 130 are shown. In FIGS. 5 and 6, first alternative stem 120 and second alternative stem 130 are sized differently from stem 24. First alternative stem 120 includes straight pipe threads 122. Stem 120 is provided with ½ inch—14 threads per inch American straight pipe threads (loose fit) (½ inch—14 NPSL), for receiving an appropriately sized lock nut. External taper threads 124 are provided with ½ inch—14 threads per inch American taper threads (½ inch—14 NPT). External taper threads 124 are sized to receive internally threaded fittings with American taper threads or British taper threads. Internal taper threads 126 are provided with ¼ inch—18 threads per inch American taper pipe threads (¼ inch—18 NPT) in the preferred embodiment. A fitting provided with external British taper threads will not readily fit into internal taper threads 126. However, stem 120 is advantageous since external taper threads 124 are usable with either a fitting 110 with American taper threads (½ inch—14 NPT) or a fitting 112 with British taper threads (½ inch—14 BSPT). It is to be appreciated internal taper threads 126 may be provided with ¼ inch British threads, or other tapered thread types and/or sizes, if desired. It is preferred that stem 120 be machined from a rod 1 and 1/16 inches in diameter during manufacture of stem 120. Aluminum 6061 may be used.

Second alternative stem 130 is sized differently from stem 24 and second alternative stem 120. Second alternative stem 130 includes straight pipe threads 132. Stem 130 is provided with 1 inch—11½ threads per inch American straight pipe threads (loose fit) (1 inch—11½ NPSL), for receiving an appropriately sized lock nut, in the preferred embodiment. External taper threads 134 are provided as 1 inch—11½ threads per inch American taper threads (1 inch—11½ NPT). It has been found that a fitting provided with internal British taper threads of 1 inch—11 threads per inch will fit into external internal taper threads and provide an appropriate seal. It is to be appreciated external taper threads 134 and straight threads 132 may be provided with other thread types and/or sizes, if desired. Internal taper threads 136 are sized to be ¾ inch type British taper threads (¾ inch—14 BSPT) to receive externally threaded fittings with American taper threads or British taper threads. Stem 130 is advantageous since internal taper threads 136 are usable with either a fitting 114 with American taper threads (¾ inch—14 NPT) or a fitting 116 with British taper threads (¾ inch—14 BSPT). It is preferred that stem 130 be machined from a rod 1 and ⅝ inches in diameter during manufacture of stem 130. Aluminum 6061 may be used.

Referring now to FIG. 3, land 54 including land surface 56 is shown in greater detail. The outer diameter defined by land surface 56 is preferably greater than or equal to the diameter defined by straight pipe threads 62. Preferably, land surface 56 is sized such that stem 24 is not misaligned during operation and a satisfactory seal is provided by O ring 52 to prevent blow by of the pressurized air or other gas out through hole 18 instead of fluidizing the material inside the container. In order to achieve a satisfactory seal, hole 18 cannot be too large. It has been found that hole 18 formed by a metric drill bit of 27 millimeters or an American drill bit of 1 and 1/16 inches provides an appropriately sized hole for a preferred land defining a diameter of 1.056 inches. It is anticipated that preferred land surface 56 may vary by +/−0.002 inches in diameter and still provide an appropriate seal. Threads 62 are sized at 1.054 inches outside diameter for the preferred ¾ inch—14 threads per inch straight threads. A 27 millimeter drill bit drills a hole about 1.063 inches in diameter. An American drill bit of 1 and 1/16 inches drill a hole about 1.062 inches in diameter. Land surface need only be sufficiently small to be positioned in the smaller opening formed by those metric and American drill bits. In this case, the smaller opening is formed by the American bit.

O ring 52 is a solid rubber O ring having the following specifications: identification number 213, an inside diameter of 0.921 inches+/−0.010 inches, and a sectional diameter of 0.139 inches. It is preferred that o-ring recess 48 begin at 0.960 inches diameter of stem 24 and include a 0.080 inch radiussed curve forming the surface of recess 48.

In this manner, an installer of aeration device 20 need only have either a standard metric drill bit set including a 27 millimeter drill bit or a standard American drill bit set including a 1 and 1/16 drill bit in order to adequately achieve a seal between aeration device 20 and the tank wall 12.

Referring again to FIG. 5, stem 120 includes a preferred land 128 defining an outer dimension of 0.860 inches+/− minus 0.002 inches. A land 128 of such dimension can be adequately sealed and positioned in a hole either ⅞ inches or 22 millimeters in diameter. It has been found that hole 18 formed by a metric drill bit of 22 millimeters or an American drill bit of ⅞ inches provides an appropriately sized hole for a land defining a diameter of 0.860 inches. It is anticipated that land surface 128 may vary by +/−0.002 inches and still provide an appropriate seal. Preferred ½ inch straight threads 122 are sized at 0.844 inches outside diameter. A 22 millimeter drill bit drills a hole about 0.866 inches in diameter. An American drill bit of ⅞ inches drills a hole equal to or about 0.875 inches in diameter. Land surface need only be sufficiently small to be positioned in the smaller opening formed by the metric and American drill bits. In this case the smaller opening is formed by the metric bit.

O ring for use with stem 120 is a rubber O ring having the following specifications: identification number 116, an inside diameter of 0.737 inches+/−0.009 inches, and a sectional diameter of 0.103 inches. It is preferred that the o-ring recess of stem 120 begin at 0.770 inches diameter of stem 124 and include a 0.060 inch radiussed curve forming the surface of the recess.

In this manner, an installer of aeration device 20 need only have either a standard metric drill bit set including a 22 millimeter drill bit or a standard American drill bit set including ⅞ drill bit in order to adequately achieve a seal between aeration device 20 and the tank wall 12 if stem 120 is used.

Referring again to FIG. 6, stem 130 includes a land 138 defining an outer dimension of 1.370 inches+/− minus 0.002 inches. A land 138 of such dimension can be adequately sealed and positioned in a hole either 1 and ⅜ inches or 35 millimeters in diameter. It has been found that hole 18 formed by a metric drill bit of 35 millimeters or an American drill bit of 1 and ⅜ inches provides an appropriately sized hole for a land defining a diameter of 1.370 inches. It is anticipated that land surface 1.370 may vary by +/−0.002 inches and still provide an appropriate seal. Preferred 1 inch straight threads 132 are sized at 1.318 inches outside diameter. A 35 millimeter drill bit drills a hole about 1.378 inches in diameter. An American drill bit of 1 and ⅜ inches drill a hole equal to or about 1.375 inches. Land surface need only be sufficiently small to be positioned in the smaller opening formed by the metric and American drill bits. In this case the smaller opening is formed by the American bit.

O ring for use with stem 130 is a rubber O ring having the following specifications: identification number 217, an inside diameter of 1.171 inches+/−0.012 inches, and a sectional diameter of 0.139 inches. The o-ring recess of stem 130 can begin at 1.260 inches diameter of stem 130 and include a 0.080 inch radiussed curve forming the surface of the recess.

In this manner, an installer of aeration device 20 need only have either a standard metric drill bit set including a 35 millimeter drill bit or a standard American drill bit set including 1 and ⅜ drill bit in order to adequately achieve a seal between aeration device 20 and the tank wall 12 if stem 130 is used.

A stem constructed as noted above with the land having the appropriate dimensions is used to advantage. Typically, an installer of aeration device 20 will have either an American drill bit set or a metric drill bit set of the type that are commonly sold by drill bit manufacturers and/or suppliers. American drill bit sets or packages commonly includes one or more drill bits of: ⅞ inches, 1 and 1/16 inches, and 1 and ⅜ inches. If one or more of these bits are not part of the package, one or more these sizes is generally easily obtainable individually. The metric bit sets or packages commonly include one or more of drill bits of: 22 millimeters, 27 millimeters, and 35 millimeters. If these bits are not part of the package, one or more of these sizes is generally easily obtainable individually. An installer need only have either an appropriately sized American bit or an appropriately sized metric bit in order to install one of stems 24, 120, 130.

From the foregoing detailed description of the present invention, it has been shown how the objects of the invention have been obtained in a preferred manner. However, modifications and equivalents of the disclosed concepts, such as those which would readily occur to one skilled in the art, are intended to be included within the scope of the claims.

What is claimed is:

1. A stem of an aeration device mountable to a container wall, the stem comprising:

(a) a shaft including:

(i) an exterior surface, the exterior surface including a first portion having American National Standard straight pipe threads thereon, the exterior surface including a second portion having American National Standard taper pipe threads thereon; and (ii) an interior surface, the interior surface defining a passageway extending from one location on the stem to another location on the stem, the interior surface including a portion having British Standard taper pipe threads thereon; and (b) valve means for controlling airflow through the inner passageway.

2. An aeration device according to claim 1, further comprising means for supplying pressurized gas to the passageway defined by the interior surface of the shaft, the means for supplying including a fitting with taper threads sized to engage one of the American National Standard taper pipe threads of the British Standard taper pipe threads, and wherein the valve means includes a flexible skirt mounted to the shaft.

3. An aeration device according to claim 1, wherein the American National Standard taper pipe threads are sized at ¾ inch—14 threads per inch threads, and wherein the British Standard taper pipe threads are sized at ½ inch—14 threads per inch threads.

4. An aeration device according to claim 1, wherein the American National Standard taper pipe threads are sized at ½ inch—14 threads per inch threads.

5. An aeration device according to claim 1, wherein the British Standard taper pipe threads are sized at ¾ inch—14 threads per inch threads.

6. An aeration system comprising:

(a) a wall forming a container for holding bulk material, the wall including a wall surface defining a hole though the wall, the hole being greater than or equal to 22 millimeters and less than or equal to ⅞ inches in diameter;

(b) a flexible skirt engageable with the wall;

(c) a stem mounted to the skirt, the stem including:

(i) an exterior surface including a threaded portion with ½ inch—14 threads per inch American Standard straight pipe threads, the exterior surface including a land sized for receipt in the hole adjacent the wall surface wherein the land has an outer diameter greater than the outer dimension of the ½ inch threads and less than 22 millimeters; and (ii) an interior surface defining a passageway through the stem; and (d) means for connecting the stem to a source of pressurized air.

7. An aeration device according to claim 6, wherein the hole is equal to ⅞ inches in diameter.

8. An aeration device according to claim 6, wherein the hole is equal to 22 millimeters in diameter.

9. An aeration system comprising:

(a) a wall forming a container for holding bulk material, the wall including a wall surface defining a hole though the wall, the hole being greater than or equal to 1 and 1/16 inches and less than or equal to 27 millimeters in diameter;

(b) a flexible skirt engageable with the wall;

(c) a stem mounted to the skirt, the stem including:

(i) an exterior surface including a threaded portion with ¾ inch type American Standard straight pipe threads, the exterior surface including a land sized for receipt in the hole adjacent the wall surface wherein the land has an outer diameter greater than or equal to the outer dimension of the ¾ inch threads and less than 1 and 1/16 inches; and (ii) an interior surface defining a passageway through the stem; and (d) means for connecting the stem to a source of pressurized air.

10. An aeration device according to claim 9, wherein the hole is equal to 1 and 1/16 inches in diameter.

11. An aeration device according to claim 9, wherein the hole is equal to 27 millimeters in diameter.

12. An aeration system comprising:

(a) a wall forming a container for holding bulk material, the wall including a wall surface defining a hole though the wall, the hole being greater than or equal to 1 and ⅜ inches and less than or equal to 35 millimeters in diameter;

(b) a flexible skirt engageable with the wall;

(c) a stem mounted to the skirt, the stem including:

(i) an exterior surface including a threaded portion with 1 inch type American Standard straight pipe threads, the exterior surface including a land sized for receipt in the hole adjacent the wall surface wherein the land has an outer diameter greater than the outer dimension of the 1 inch threads and less than 1 and ⅜ inches; and (ii) an interior surface defining a passageway through the stem; and (d) means for connecting the stem to a source of pressurized air.

13. An aeration device according to claim 12, wherein the hole is equal to 1 and ⅜ inches in diameter.

14. An aeration device according to claim 12, wherein the hole is equal to 35 millimeters in diameter.

15. An aeration device for mounting to a wall with a hole therethrough comprising:

(a) a flexible skirt;

(b) a stem extending from the skirt, the stem including:

(i) an exterior surface including a first portion having straight pipe threads, and a second portion having taper pipe threads;

(ii) an interior surface defining a passageway through the stem, wherein the interior surface includes taper pipe threads;

(c) a threaded nut mounted to the straight pipe threads of the stem on an opposite side of the wall relative to the flexible skirt; and (d) a fitting including one of an internal surface portion having taper pipe threads engageable with the taper pipe threads on the exterior surface of the stem or an external surface portion having taper pipe threads engageable with the taper pipe threads on the interior surface of the stem.

16. An aeration device according to claim 15, wherein the straight threads on the exterior surface are ½ inch—14 threads per inch American National Standard pipe threads, wherein the taper threads on the exterior surface are ½ inch—14 threads per inch American National Standard pipe threads, and wherein the taper threads on the interior surface are ¼ inch—18 threads per inch American National Standard taper threads.

17. An aeration device according to claim 15, wherein the straight threads on the exterior surface are ¾ inch—14 threads per inch American National Standard pipe threads, wherein the taper threads on the exterior surface are ¾ inch—14 threads per inch American National Standard pipe threads, and wherein the taper threads on the interior surface are ½ inch—14 threads per inch British Standard taper threads.

18. An aeration device according to claim 15, wherein the straight threads on the exterior surface are 1 inch—11½ threads per inch American National Standard pipe threads, wherein the taper threads on the exterior surface are 1 inch—11½ threads per inch American National Standard pipe threads, and wherein the taper threads on the interior surface are ¾ inch—14 threads per inch British Standard taper threads.

19. An aeration system comprising:

(a) a wall forming a container for holding bulk material, the wall including a wall surface defining a hole though the wall, the hole being greater than or equal to 22 millimeters and less than or equal to ⅞ inches in diameter;

(b) a flexible skirt engageable with the wall;

(c) a stem mounted to the skirt, the stem including:

(i) an exterior surface including a first threaded portion with ½ inch—14 threads per inch American Standard straight pipe threads, the exterior surface including a second threaded portion with ½ inch—14 threads per inch American National Standard taper pipe threads, the exterior surface including a land sized for receipt in the hole adjacent the wall surface wherein the land has an outer diameter greater than or equal to 0.858 inches and less than 22 millimeters; and (ii) an interior surface defining a passageway through the stem, the interior surface including a tapered threaded portion; and (d) means for connecting the stem to a source of pressurized air.

20. An aeration system comprising:

(a) a wall forming a container for holding bulk material, the wall including a wall surface defining a hole though the wall, the hole being greater than or equal to 1 and 1/16 inches and less than or equal to 27 millimeters in diameter;

(b) a flexible skirt engageable with the wall;

(c) a stem mounted to the skirt, the stem including:

(i) an exterior surface including a first threaded portion with ¾ inch—14 threads per inch American Standard straight pipe threads, the exterior surface including a second threaded portion with ¾ inch—14 threads per inch American National Standard taper pipe threads, the exterior surface including a land sized for receipt in the hole adjacent the wall surface wherein the land has an outer diameter greater than or equal to 1.054 inches and less than 1 and 1/16 inches; and (ii) an interior surface defining a passageway through the stem, the interior surface including a threaded portion with ½ inch—14 threads per inch British Standard taper threads; and (d) means for connecting the stem to a source of pressurized air.

21. An aeration system comprising:

(a) a wall forming a container for holding bulk material, the wall including a wall surface defining a hole though the wall, the hole being greater than or equal to 1 and ⅜ inches and less than or equal to 35 millimeters in diameter;

(b) a flexible skirt engageable with the wall;

(c) a stem mounted to the skirt, the stem including:

(i) an exterior surface including a first threaded portion with 1 inch—11 and ½ threads per inch American Standard straight pipe threads, the exterior surface including a second threaded portion with 1 inch—18 threads per inch American National Standard taper pipe threads, the exterior surface including a land sized for receipt in the hole adjacent the wall surface wherein the land has an outer diameter greater than or equal to 1.368 inches and less than 1 and ⅜ inches; and (ii) an interior surface defining a passageway through the stem, the interior surface including a threaded portion with ¾ inch—14 threads per inch British Standard taper threads; and (d) means for connecting the stem to a source of pressurized air.

22. The aeration system of claim 19, wherein the tapered threaded portion on the interior surface of the stem includes ¼ inch—18 threads per inch American National Standard taper threads.

23. The aeration system of claim 20, wherein the tapered threaded portion on the interior surface of the stem includes ½ inch—14 threads per inch British Standard taper threads.

24. The aeration system of claim 21, wherein the tapered threaded portion of the interior surface of the stem includes ¾ inch—14 threads per inch British Standard taper threads.

* * * * *

UNITED STATES PATENT AND TRADEMARK OFFICE

CERTIFICATE OF CORRECTION

PATENT NO. : 5,381,606

DATED : January 17, 1995

INVENTOR(S) : Keith F. Solimar

It is certified that error appears in the above-identified patent and that said Letters Patent is hereby corrected as shown below:

Column 3, Line 68, "seem" should read --stem--.

Claim 6, Column 11, Line 42, "though" should read --through--.

Claim 9, Column 11, Line 66, "though" should read --through--.

Claim 12, Column 12, Line 22, "though" should read --through--.

Claim 19, Column 13, Line 22, "though" should read --through--.

Claim 20, Column 13, Line 45, "though" should read --through--.

Claim 21, Column 14, Line 18, "though" should read --through--.

Signed and Sealed this

Sixteenth Day of May, 1995

*Attest:*

Bruce Lehman

BRUCE LEHMAN

*Attesting Officer*

*Commissioner of Patents and Trademarks*